United States Patent [19]

Abe et al.

[11] Patent Number: 4,546,007

[45] Date of Patent: Oct. 8, 1985

[54] MULTI-LAYER COATING METHOD BASED ON SPECTRAL REFLECTANCE OF WHITE OR GRAY COLORS

[76] Inventors: Yoshiaki Abe, 12-352 Yuden, Iseda-cho, Uji-shi, Kyoto-fu; Masaaki Koyama, 8-5, Ishiki-cho, 2-chome, Kariya-shi, Aichi-ken, both of Japan

[21] Appl. No.: 535,758

[22] Filed: Sep. 26, 1983

[30] Foreign Application Priority Data

May 21, 1983 [JP] Japan ..... 58-89604

[51] Int. Cl.[4] ..... B05D 3/02

[52] U.S. Cl. ..... 427/8; 356/402; 427/407.1

[58] Field of Search ..... 356/402, 405, 406; 427/8, 407.1; 209/580

[56] References Cited

U.S. PATENT DOCUMENTS

| | | | |
|---|---|---|---|
| 3,690,771 | 9/1972 | Armstrong, Jr. et al. | 356/405 |
| 3,916,168 | 10/1975 | McCarty et al. | 356/405 X |
| 4,273,690 | 6/1981 | Walus | 427/407.1 X |
| 4,416,940 | 11/1983 | Loye et al. | 427/407.1 X |

FOREIGN PATENT DOCUMENTS

| | | | |
|---|---|---|---|
| 2452113 | 6/1976 | Fed. Rep. of Germany | 356/402 |
| 1109642 | 4/1968 | United Kingdom | 356/402 |

*Primary Examiner*—Thurman K. Page

*Attorney, Agent, or Firm*—Wenderoth, Lind & Ponack

[57] ABSTRACT

The invention provides a method for forming a multi-layer coating comprising applying over an intercoat of a white or gray color, a colored top coat at incomplete hiding, thereby obtaining a color very similar with that of a top coat applied at complete hiding. This invention also provides a simple way for determining an appropriate intercoat color for a given top coat color.

3 Claims, 10 Drawing Figures a) R

MULTI-LAYER COATING METHOD BASED ON SPECTRAL REFLECTANCE OF WHITE OR GRAY COLORS

FIELD OF INVENTION

The present invention relates to a method for forming a multi-layer coating and more specifically a method for forming a multi-layer coating comprising applying over an intercoat of a white or gray color, a colored top coat at incomplete hiding so as to produce a color very similar to that of a top coat applied at complete hiding. This invention provides the simplest way for determining an appropriate intercoat color for a given top coat.

BACKGROUND OF THE INVENTION

In a coating area, a top coat is usually applied over an intercoat (or underlying coat) at complete hiding, i.e. to cover up the same. At this time, since the hiding power differs considerably from pigment to pigment, the actual top coat thickness likewise varies in a considerable range from coating to coating. If a low hiding paint composition whose hiding power is in the order of about 50~250μ as expressed herein in terms of film thickness required for hiding the JIS contrast chart (reflectance of white substrate: Rw=80±1%; reflectance of black substrate: Rb≦2%) by visual judgement, is to be applied as a top coat, repeated and somewhat complicated coating operations are always required. This makes for a very time consuming procedure and hence is not practicable. Even in the case of using a higher hiding paint composition, if the substrate is of a complicated structure and there are hidden portions which make it difficult to coat the substrate, it is not possible to cover up the whole area equally and there often results a lack of hiding from portion to portion. If one wishes to have a complete hiding, then there results the problem of sagging at the other portions because of the excessive coating applied thereupon. Therefore, it is very difficult to hide thoroughly the intercoat with a normal application thickness of 30 to 40μ. On the other hand, a highly chromatic coating has been welcomed in the market in recent years. Since the most organic pigments used in such coating have a fairly low hiding power, considerable quantities of such pigment must be added to the top coat composition to result in a complete hiding of the intercoat and a film thickness of about 30~40μ is required. Employment of such a larger quantities of pigment, however, may cause additional problems, under normal conditions, in that the painted film lacks gloss, the coating composition is highly viscose and the film exhibits poor weather resistance. Therefore, in such a case one cannot help but use coatings such that they incompletely hide the intercoating. For this reason, applicants are forced to select an intercoat which is the same or somewhat similar to a given colored top coat. However, there is no established standard for selecting such intercoats and therefore, at the time when different kinds of pigments are to be used in the intercoat and in the top coat, one must necessarily rely on a trial and error system for the determination of an appropriate color combination. Such a working procedure is indeed time consuming and inefficient. Furthermore, since the colored intercoat does include a higher concentration of pigment of the same, or substantially same hue as that of the top coat, there is a serious problem of raising up the cost as a matter of course. Therefore, if an appropriate intercoat color, which may give as small color difference between the composite coating having a low hiding top coat applied at 30~40μ thickness, i.e. at incomplete hiding, over the intercoat and a coating having the same top coat applied under complete hiding conditions, can be easily determined from a wider range of colors, it would be extremely beneficial in widening the color gamut of the top coat. This would open the way for using low hiding pigments previously thought to be unsuitable for use in a top coat where no adequate color for the intercoat has previously existed. The selection of such top coat would also shorten the time for selecting an appropriate intercoat color for a given top coat, thus lowering the cost of the intercoats and top coats due to the decrease in the amount of pigment and also in shortening the application time and the like.

The inventors have previously found a method of forming a highly chromatic multi-layer colored coating of red (Munsell renotation hue R series) yellow (Munsell renotation hue Y series) or orange (Munsell renotation hue YR series) comprising applying over a colored intercoat a low hiding colored top coat at incomplete hiding but which top coat has a color difference of less than 1.0 as compared with the color of the same top coat applied at complete hiding. This is achieved by selecting the intercoat color so as to fulfill the requirement:

$$\Sigma|\Delta R\lambda| \leqq 0.5$$

wherein $\Sigma|\Delta R\lambda|$ stands for the summation of absolute values of $\Delta R\lambda$, and $\Delta R\lambda$ is the differentia between the spectral reflectance ($RM\lambda$) of the top coat applied at complete hiding and the spectral reflectance ($RG\lambda$) of the intercoat applied at complete hiding at the respective wavelength ($\lambda$) at intervals of 20 nm in the selected wavelength region ranging from the point, at which the reflectance curves over the white and the black substrates of the JIS contrast chart of the top coat applied at incomplete hiding and in a defined film thickness, is more than 1% to 700 nm. According to this method it is also required that the reflectance curves of the complete hiding top coat and of the complete hiding intercoat come approximately near to each other only in the abovementioned selected wavelength region. Applicants have applied for a patent for this invention in Japanese Patent Application No. 49632/82, on Mar. 27, 1982. As already stated, when different kinds of pigments are to be used in the intercoat and the top coat, no reliable and established method had been known for the selection of an appropriate intercoat color which might be the same or quite similar color to that of the top coat, thus the intercoat was selected by trial and error, which is both time consuming and inefficient. The abovesaid was indeed a very important and useful invention in a sense that an appropriate intercoat color could be easily determined from a number of colors for a given top coat. However, since the selection of a colored intercoat similar to that of the top coat is the prerequisite of that invention, it is of course essential that the color be selected as close as possible to the top coat color. On the other hand, a pigment of a high hiding power is generally required for an intercoat. There are many cases wherein the composite structure of a low hiding top coat and a high hiding inter coat be required. At that time, since the both paints markedly differ from each other in pigment composition and in their compounding ratio, difficulties are apt to occur in the selection of optimum intercoat color. If it is possible to use an intercoat of universal color unrelated to the top coat color and obtain a multi-layer coating comprising a colored top coat applied over the intercoat under incomplete hiding conditions, while still maintaining a color similar to that of the top coat applied at complete hiding, it would be an inestimable advance of the art.

The inventors, for the purpose of determining the wavelength region in which the intercoat color will exert influence upon the top coat color, have applied a top coat at incomplete hiding and at a defined film thickness (30~40μ) over the white and the black substrates of a JIS contrast chart and examined the spectral reflectance (Rwλ) over the white substrate and the spectral reflectance (RBλ) over the black substrate, as well as the spectral reflectance (RMλ) of the top coat applied at complete hiding, at the respective point at intervals of 20 nm in the wavelength region from 400 to 700 nm (visible wavelength region). The thus-obtained data were then plotted in the same chart to draw three spectral reflectance curves for three respective colors. These curves are shown in FIG. 1, in which (A) is for the R series (Munsell renotation hue, hereinafter the same) color, (B) is for the GY,G,BG or the B series color and (C) is for the PB series color, and in each drawing, the FIG. 1 represents the spectral reflectance curve of top coat applied at complete hiding and the FIGS. 2 and 3 are of the same top coats applied over the white and the black substrates at incomplete hiding, respectively. Though a color shows each different curve pattern, it is clear that in any case, the spectral reflectance curve (1) of the top coat applied at complete hiding is always between the curves (2) and (3) of the same top coats applied over the white and the black substrates at incomplete hiding. This clearly indicates that if one were to apply the top coat over the intercoat of a grayish color, (i.e. a mixed color of white and black) under incomplete hiding conditions, the corresponding spectral reflectance curve must be at a very close position to the spectral reflectance curve (1).

The invention has been made starting from the aforesaid theoretical studies.

SUMMARY OF THE INVENTION

According to the invention, there is provided a method of forming a multi-layer coating comprising applying over an intercoat a top coat at incomplete hiding so as to produce a very similar color to that of the top coat applied at complete hiding, which is characterized in that the intercoat color is selected from white or gray colors whose spectral reflectance comes as close as possible to the maximum value of the spectral reflectance curve of the complete hiding top coat.

In one aspect of the invention, there is provided a method wherein the top coat is possessed of colors whose spectral reflectance curves have the largest and maximum peaks in a wavelength region of less than 640 nm, and the color similarity is such that when the top coat is applied at one half of the film thickness required for complete hiding, the color difference is less than 1.0 as compared with the color of a complete hiding top coat. The term "spectral reflectance comes as close as possible" means a spectral reflectance which is within ±28% of the maximum reflectance, measured at the wavelength at which the spectral reflectance curve of the complete hiding top coat will show the maximum value, of said top coat.

In another aspect of the invention, there is provided a method wherein the top coat is possessed of a color whose spectral reflectance curves has the largest or maximum peak in a wavelength region of over 640 nm, said color similarity being such that when the top coat is applied over the intercoat at one half of the film thickness required for complete hiding, the color difference is less than 1.0 as compared with the color of a top coat of complete hiding power. The term "spectral reflectance comes as close as possible" means, "when expressed in terms of average value of spectral reflectances measured at 4 points at intervals of 20 nm in a longer wavelength region ranging from 640 to 700 nm, an average reflectance which is within ±25% of that of complete hiding top coat".

DESCRIPTION OF THE PREFERRED EMBODIMENTS

From the abovesaid preliminary studies, it was indeed found that if a colored top coat was applied under incomplete hiding conditions over a gray colored intercoat, the spectral reflectance curve located at closer position to the curve of top coat applied at complete hiding might be obtained, and that the actual position would be fluctuated between those of curves (2) and (3) depending on the grayness of the intercoat to be used.

However, the question is on what basis that an optimum grayness of the intercoat for a given top coat be selected and determined.

Figure 1A:
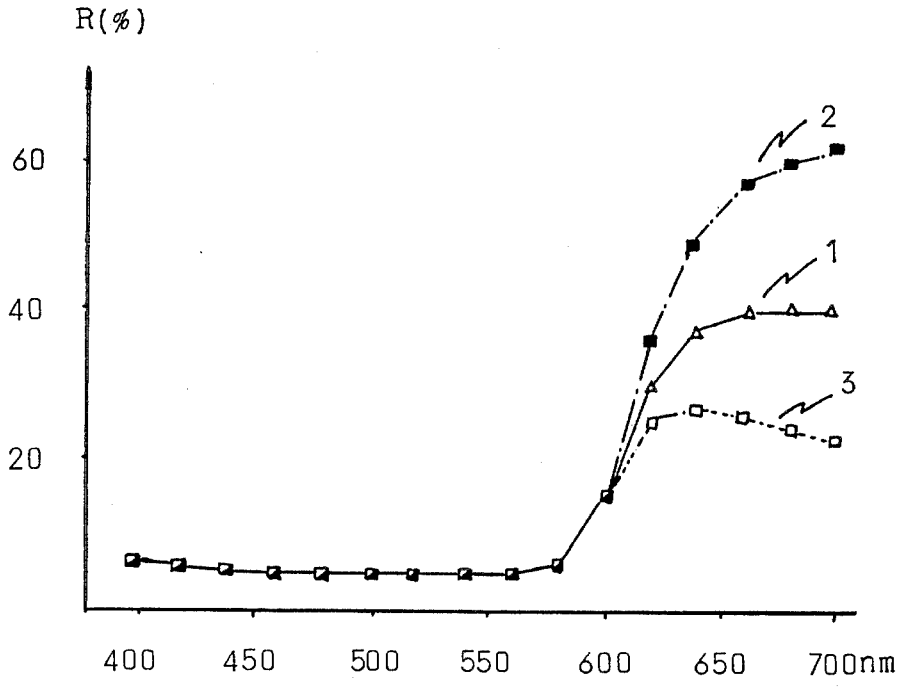
Figure 1B:
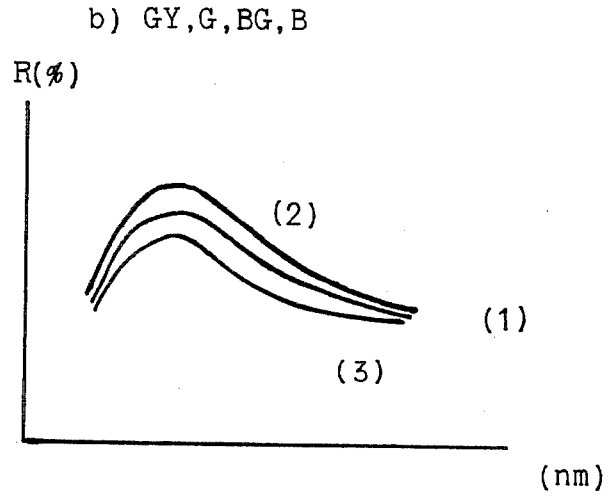
Figure 1C:
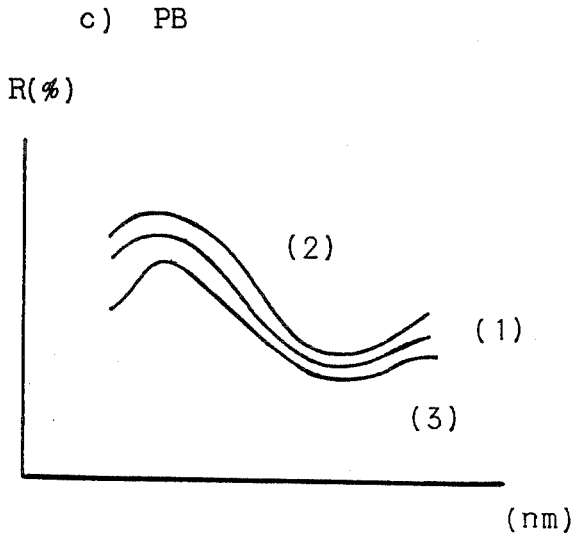

Referring to FIGS. 1 (A), (B) and (C), it is seen that curve patterns are roughly divided in two classes, one being the curves having no up-and-down peak(s) and having the largest or maximum peak in a wavelength region of over 640 nm as represented by (A) for a Munsell renotation hue R,Y,YR and RP series colors and the other being the curves having up-and-down peak(s) and having the largest and maximum peak(s) in a wavelength region of less than 640 nm as represented by (B) and (C) for the GY, G, BG, B and PB series colors. Furthermore, the former somewhat differs from the latter in the curve format at the foot portion thereof. Therefore, studies have been made on the respective type of top coat colors.

(1) Top coat colors whose spectral reflectance curves each shows the largest and maximum peak in a wavelength region of less than 640 nm:

In these type of colors, the reflectance curve of the top coat applied at complete hiding always lies at an interposition between the curves of the same top coat applied over the white and the black substrates at incomplete hiding (see FIGS. 1 (B) and (C)) and therefore, it is expected that the optimum intercoat colors would be in gray colors and that such gray might have a reflectance curve which is approximately contiguous to that of a complete hiding top coat at a wavelength region where the largest or maximum peak is present. With the abovesaid in minds, the following experiments were carried out.

As the top coat color, a Medium Green (Munsell renotation hue 9.22GY/value 7.83/chroma 9.15; hiding power 126μ) was used in these tests.

Figure 2:
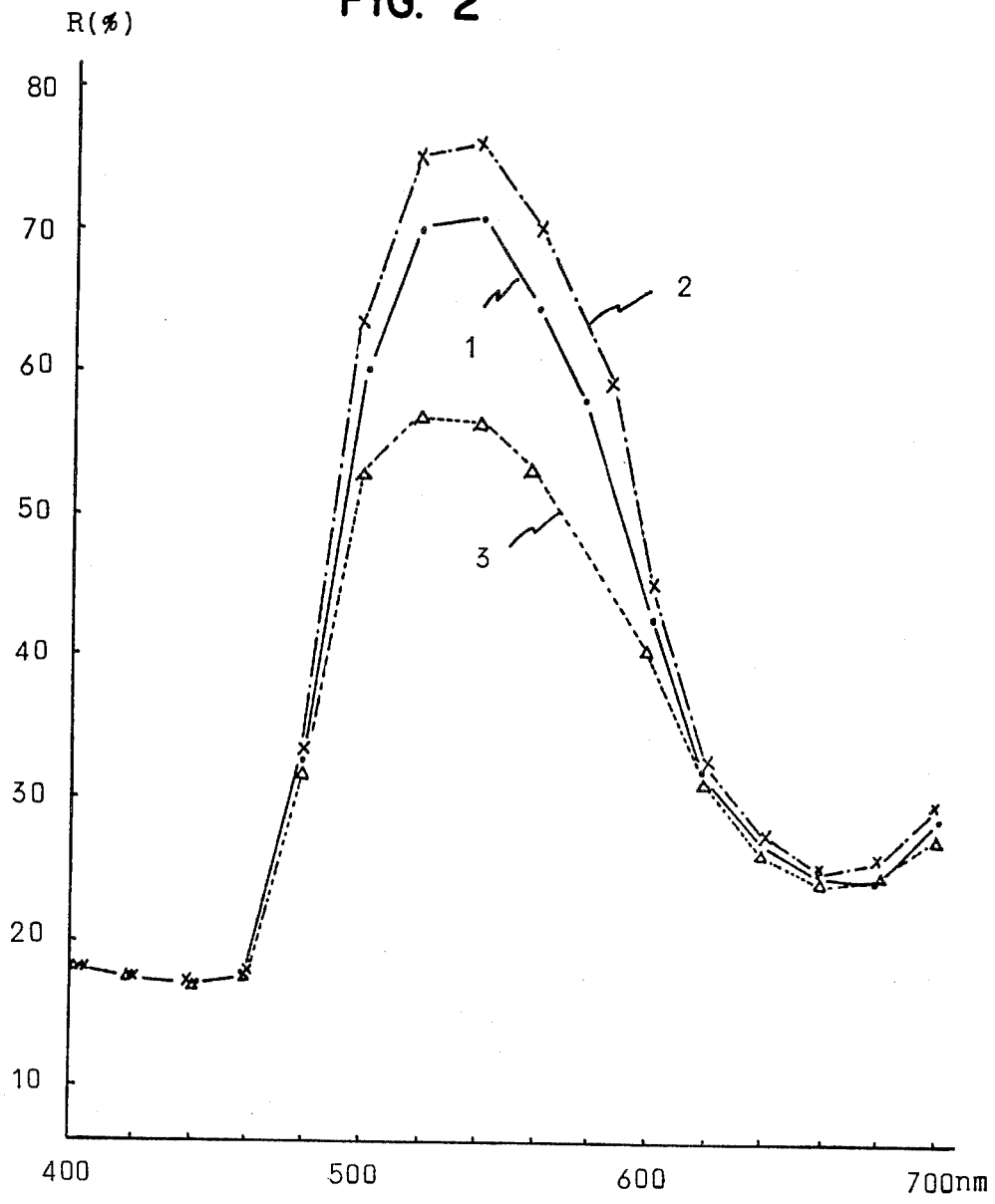

With respect to the top coats applied over the white and the black substrates of the JIS contrast chart at incomplete hiding at 27μ, and top coat applied at complete hiding, the spectral reflectances at the respective points at intervals of 20 nm in a visible wavelength region (400~700 nm) were measured and plotted in the same chart to obtain the spectral reflectance curves as shown in FIG. 2.

This indicates the fact that each and every curve show the maximum reflectances at around 540 nm, and the curve (1) of the top coat of complete hiding power lies between the curves (2) and (3) of the incomplete hiding top coats aligned over the white and the black substrates. It is thus clear that the wavelength region where the intercoat color will exert the substantial effect on the color shade of the top coat is 540 nm and around this same wavelength. Paying due attention to this particular wavelength, various grades of gray colors which are distinguishable from each other by the spectral reflectance at 540 nm, were provided and over the respective gray colored intercoats, were applied the top coats of the abovementioned color at varying film thickness under incomplete hiding conditions. Thereafter, the color differences between the composite coatings and the complete hiding top coat were measured and the results were shown in the following Table 1 and FIG. 3.

TABLE 1

| grade of gray color* | Medium Green (hiding power 126μ) film thickness (μ) | color difference |
|---|---|---|
| G-86.6 | 57.6 | 1.53 |
| | 84.0 | 0.60 |
| G-78.9 | 58.3 | 1.07 |
| | 84.8 | 0.23 |
| G-67.6 | 31.1 | 0.97 |
| | 61.0 | 0.25 |
| G-60.6 | 26.4 | 2.73 |
| | 57.8 | 0.45 |
| | 86.4 | 0.13 |
| G-51.3 | 30.4 | 4.21 |
| | 62.1 | 0.71 |
| | 89.2 | 0.14 |
| G-44.8 | 57.0 | 1.21 |
| | 80.3 | 0.31 |

*spectral reflectance measured at 540 nm

Figure 3:
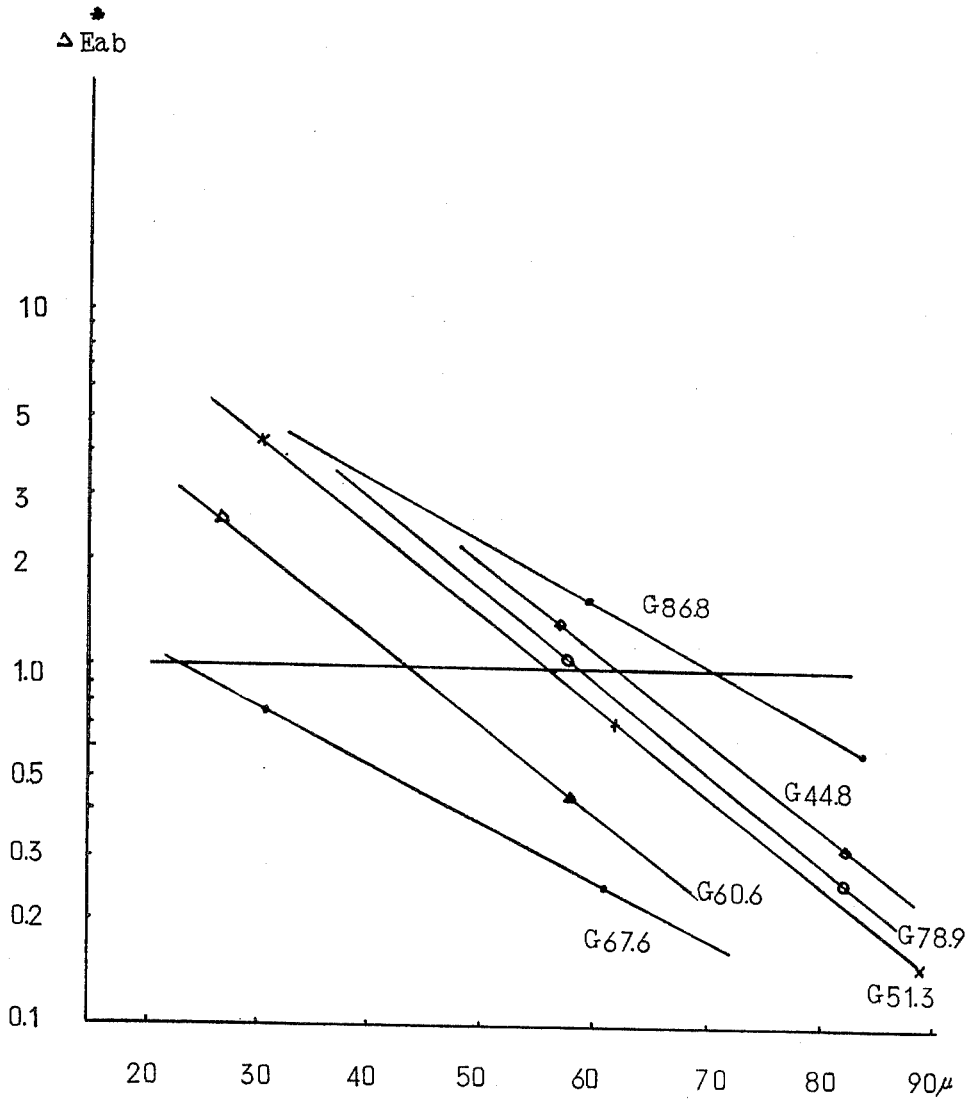
Figure 4:
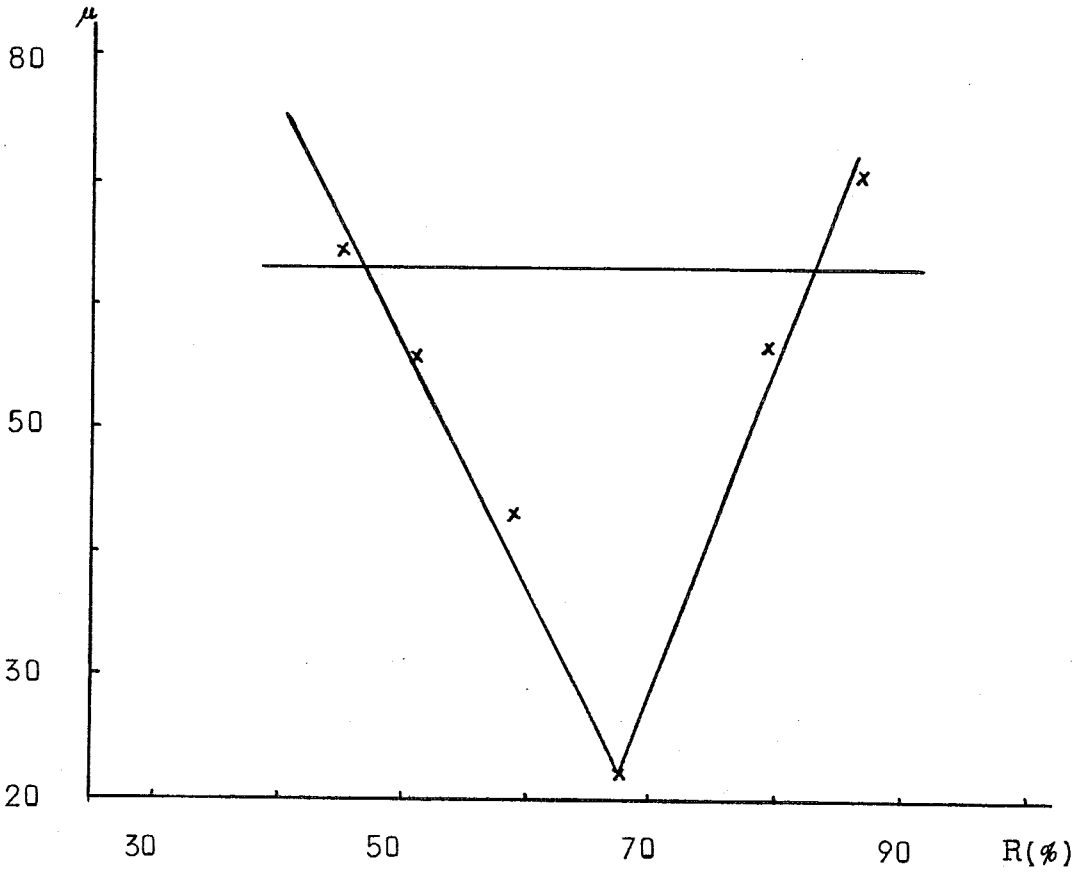

The relationship between the film thickness of the top coat and the color difference actually measured is shown in FIG. 3. Since an object of the invention is to provide a multi-layer coating comprising a top coat applied over an intercoat under incomplete hiding conditions, which top coat has a minimized color difference of less than 1.0 as compared with the color of complete hiding top coat, special regard has to be paid to the film thickness of the top coat showing the color difference (ΔE* ab) of 1.0 in said FIG. 3. The inventors then read out, for the respective grade of gray color, the film thickness of the top color at the level of color difference of 1.0 and made up the FIG. 4, in which the horizontal axis represents the spectral reflectance R(%) of a gray color measured at 540 nm and the vertical axis represents the film thickness (μ) of a top coat showing the color difference (ΔE* ab) of 1.0. This drawing indicates the film thickness of the top coat to be applied over the gray colored intercoat, necessitated a color difference of 1.0 as compared with the color of complete hiding top coat. These FIGS. 3 and 4 show that the intercoat on which the thinnest top coat can be applied (i.e. the best intercoat) is of a Gray G-67.6 color, i.e. the gray color whose spectral reflectance measured at 540 nm is 67.6%, thus approximating the maximum reflectance of 70% of the top coat color. Further, the thicker the film thickness of the top coat required for giving ΔE* ab=1, the larger the allowable reflectance of suitable gray color measured at 540 nm.

When the film thickness of the top coat to be applied at incomplete hiding is fixed at one half of the film thickness required for complete hiding (in this case, 126μ), the gray colors capable of producing a color difference (ΔE* ab) of 1.0 are possessed of reflectances, measured at 540 nm, of 48% and 83%, respectively. Therefore, to satisfy the requirement of ΔE* ab≦1.0, the spectral reflectance of the gray color should be in a range of 48~83%, which corresponds to −22%~+13% of the abovementioned maximum reflectance $R_o$ of the top coat, i.e. 70%.

Similar experiments were carried out with other typical colors coming to the indicated category and the following

TABLE 2

| top coat color*1 (Munsell renotation) | hiding power (μ) | spect. reflec. $R_o$ (%) of optimum gray*2 | reflectance range R (%) of allowable gray giving ΔE* ab ≦ 1.0 at ½T top coat*2 | reflectance allowance from optim. gray $R_o$ (%) |
|---|---|---|---|---|
| 3.48P/5.13/5.36 | 137 | 38.2 | 24~53.5 | −15~+14.5 |
| 5.24PB/6.11/6.68 | 110 | 59.2 | 33~69.5 | −26~+10.5 |
| 7.15PB/3.23/5.49 | 80.6 | 20.2 | 9~30.5 | −11~+10.5 |
| 4.69PB/7.99/4.27 | 51.1 | 80.6 | 58~91 | −21~+12 |
| 5.21PB/6.43/6.48 | 39.2 | 63.2 | 54~64 | −5.5~+4.5 |
| 9.22GY/7.83/9.15 | 126 | 70.2 | 48~83 | −22~+13 |
| 0.80G/5.36/9.91 | 86.1 | 35.2 | 22.5~49 | −12.5~+14 |
| 0.68GY/7.62/9.40 | 25.9 | 67.3 | 62.5~84 | −7.5~+14 |
| 0.83G/5.29/9.75 | 50.1 | 34.1 | 19~63 | −16~+28 |
| 7.13BP/3.23/5.50 | 44.9 | 19.2 | 7~33 | −12~+13.8 |
| silver*3 | 50.0 | 59.0 | 32~83 | −28~23 |

*1hue/value/chroma:
*2measured at the wavelength showing maximum reflectance of the top coat color:
*3Evaluated at the front face of 2 coat-1 bake plate (silver paint cont.PWC4% of Al flake pigment and clear coat, appled. on wet cond., the baked)

results as given in Table 2 were obtained. From these experiments, it is clear that for this type of top colors, if the intercoat color is selected from gray colors whose reflectance, measured at the wavelength at which the spectral reflectance curve of the complete hiding shows the largest and maximum peak, is within ±28%, preferably ±15%, of the maximum reflectance of said top color. Thus, very similar color, i.e. a color difference of less than 1.0, with that of complete hiding top coat may be obtained even when the top color is applied at incomplete hiding corresponding to one half of the film thickness required for complete hiding (T). Thus, in the first aspect of this invention, there is provided a method of forming a multi-layer coating comprising applying over an intercoat, a top coat under incomplete hiding conditions so as to give a very similar color to that of top coat applied at complete hiding. This is characterized in that the top coat is possessed of color whose spectral reflectance curve has the largest and maximum peak in a wavelength region of less than 640 nm, and the intercoat color is selected from white or gray colors whose spectral reflectance measured at the wavelength at which the spectral reflectance curve of the complete hiding top coat will show the maximum value, is within ±28% of the maximum reflectance of said top coat, thereby attaining the effect such that even when the top coat is applied at one half of the film thickness required for complete hiding, the color difference is less than 1.0 as compared with the color of said complete hiding top coat.

(2) Top coat colors whose spectral reflectance curves each shows the largest or maximum peak in a wavelength region of over 640 nm:

In these type of colors, the largest or maximum peak is present each in a different position from those of the colors of the preceding paragraph (1).

In FIG. 1, the FIG. 1 represents the spectral reflectance curve of the top coat of a red color (RED S1) applied at complete hiding, the FIG. 2 is of the same top coat applied over the white substrate at about 34μ thickness at incomplete hiding and the FIG. 3 is of the same top coat applied over the black substrate at about 34μ thickness at incomplete hiding. Referring to the same, it is clear that these three curves almost overlap one another in the light absorption wavelength region and is materialized in the relationship:

$$R_M\lambda \approx Rw\lambda \approx R_B\lambda$$

in which $R_M\lambda$ is the spectral reflectance of complete hiding top coat, $Rw\lambda$ is of the incomplete hiding top coat applied over the white substrate and $R_B\lambda$ is of the incomplete hiding top coat applied over the black substrate at a wavelength λ, respectively.

However, in the light reflection wavelength region, these three are diverged from each other and are materialized in the relationship:

$$Rw\lambda > R_M\lambda > R_B\lambda$$

Figure 5:
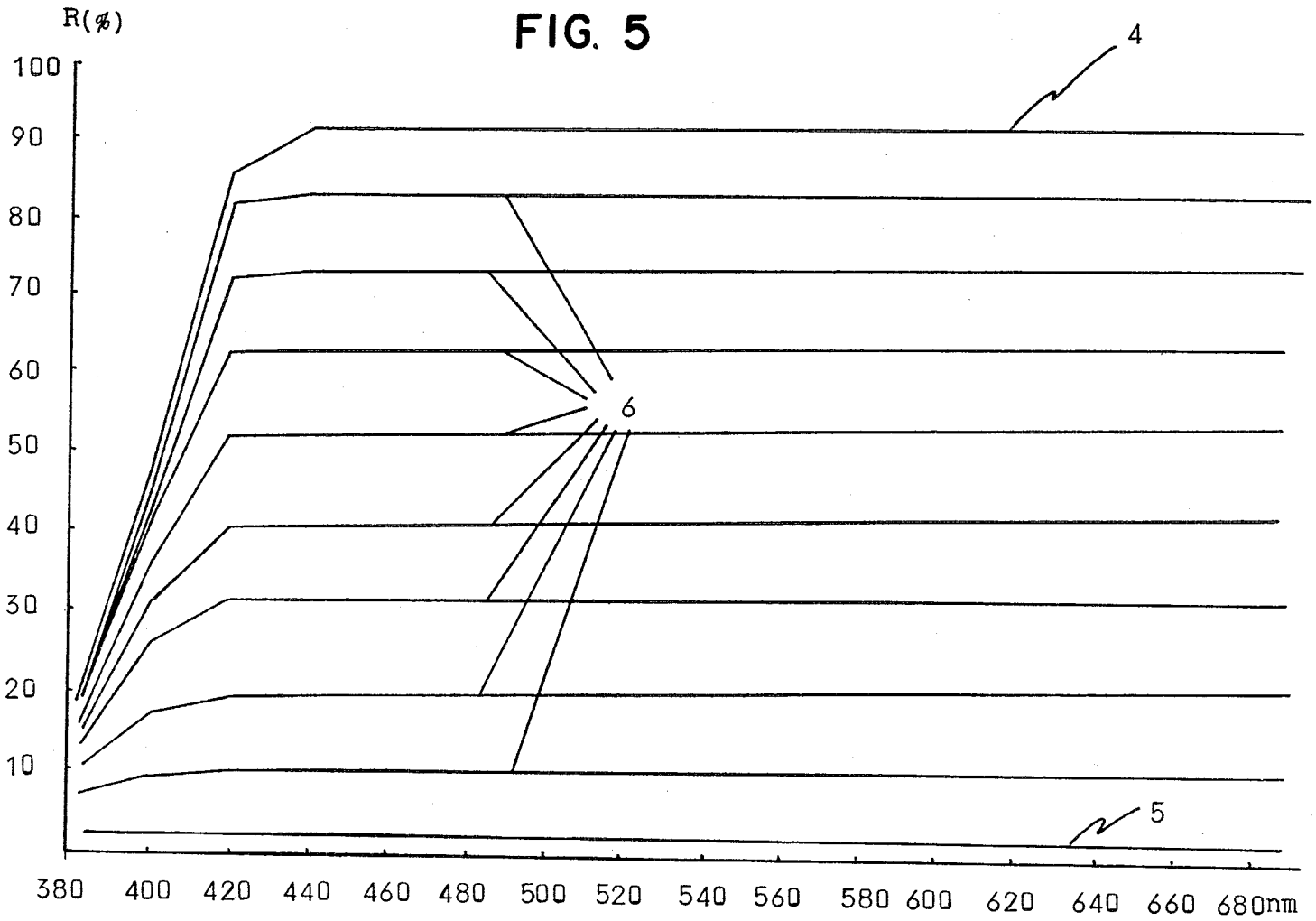

Thus, the wavelength region in which the intercoat will exert influence on the color of top coat is in the light reflection area, i.e. from this diverging point to 700 nm. Supposing the reflectance difference of below 1% at the same wavelength in the reflectance curves over the white and the black substrates will indicate no significant difference in substance, the wavelength region in which the intercoat will give substantial effect on the color of the top coat is a longer wavelength region ranging from the point at which the reflectance difference at the same wavelength in which the reflectance curves over the white and the black substrates is more than 1%, to the maximum of 700 nm. More specifically, such longer wavelength region is 620~700 nm for the RED R, 600~700 nm for the ORANGE YR and 540~700 nm for the YELLOW Y. On the other hand, as shown in FIG. 5, the spectral reflectance curves of gray colors will appear as linear lines each in parallel to the horizontal axis and somewhat descending to 700 nm, and they are running almost parallel, in an up and down relationship to each other depending on the grayness of the color.

Therefore, in order to bring the spectral reflectance curve of the top coat applied over a gray colored intercoat at incomplete hiding in close proximity to the curve of the complete hiding top coat, the intercoat should prefereably be of a gray color whose reflectance curve at the complete hiding is close to that of the complete hiding top coat in a longer wavelength region (640~700 nm) in where the reflectance curve shows almost straight line, in other words, the average reflectance in that region is almost identical with the corresponding average reflectance of the complete hiding top coat. The term "average spectral reflectance" as used herein indicates the mean value of spectral reflectances measured at four points at intervals of 20 nm in a longer wavelength region from 640 to 700 nm.

The abovesaid is based upon the idea that since the influence of the intercoat upon the top coat color is most remarkable at a wavelength region where the largest or maximum peak is present in the spectral reflectance curve, if the gray color whose reflectance curve is approximately contiguous to that of the complete hiding top coat in that wavelength region, then the reflectance curve of the integrated coating obtained by applying the top coat in an incomplete hiding over the gray colored under coat would also be very close to that of complete hiding top coat in an other wavelength region.

At the time when a top coat is applied over an intercoat at incomplete hiding (for example, in one half film thickness as compared with the thickness at complete hiding), it is quite difficult and even unnecessary to obtain substantially the same color as that of a complete hiding top coat. A color difference of less than 1.0 will suffice enough to achieve the intended objects in many cases. Now that there is a degree of allowance in said color difference, it is quite natural that a certain tolerance be allowed in the employable grayness of the intercoat color.

The inventors have now conducted the following tests:

In the first series of tests, RED SI (red series color) was used as a top coat color and various gray colors (No. 1~No. 5) were provided as an intercoat color.

A standard sample was prepared by applying a RED SI (hiding power 135μ) coating composition on a substrate at complete hiding and spectral reflectances at 640, 660, 680 and 700 nm were measured by using a spectrophotometer. The results are shown in the following Table 3.

TABLE 3

| wavelength (nm) | spectral reflectance (%) |
|---|---|
| 640 | 37.56 |
| 660 | 40.25 |
| 680 | 40.46 |
| 700 | 40.23 |
| average reflectance | 39.63 |

Next, for the respective gray color applied at complete hiding, the reflectance at each points at intervals of 20 nm in a visible wavelength region from 400 to 700 nm was likewise measured and the results were shown in Table 4.

TABLE 4

| wavelength (nm) | No. 1 | No. 2 | No. 3 | No. 4 | No. 5 |
|---|---|---|---|---|---|
| 400 | 36.06 | 34.68 | 31.79 | 26.56 | 22.78 |
| 420 | 52.95 | 48.77 | 42.41 | 32.50 | 26.64 |
| 440 | 53.07 | 48.85 | 42.38 | 32.41 | 26.51 |
| 460 | 52.93 | 48.63 | 42.13 | 32.15 | 26.30 |
| 480 | 52.73 | 48.39 | 41.92 | 31.98 | 26.13 |
| 500 | 52.50 | 48.22 | 41.71 | 31.75 | 25.92 |
| 520 | 52.24 | 47.92 | 41.40 | 31.48 | 25.69 |

TABLE 4-continued

| wavelength (nm) | No. 1 | No. 2 | No. 3 | No. 4 | No. 5 |
|---|---|---|---|---|---|
| 540 | 52.01 | 47.69 | 41.16 | 31.25 | 25.50 |
| 560 | 51.69 | 47.40 | 40.85 | 30.96 | 25.22 |
| 580 | 51.34 | 47.01 | 40.47 | 30.66 | 24.95 |
| 600 | 51.01 | 46.70 | 40.13 | 30.36 | 24.65 |
| 620 | 50.58 | 46.26 | 39.73 | 30.01 | 24.36 |
| 640 | 50.25 | 45.92 | 39.39 | 29.70 | 24.10 |
| 660 | 49.79 | 45.50 | 39.00 | 29.33 | 23.77 |
| 680 | 49.37 | 45.08 | 38.62 | 29.04 | 23.49 |
| 700 | 49.11 | 44.79 | 38.27 | 28.76 | 23.24 |
| average reflectance | 49.63 | 45.32 | 38.82 | 29.21 | 23.65 |

In this table, the indicated average reflectance is the mean value of four reflectances at 640, 660, 680 and 700 nm. When compared this data with the aforesaid average reflectance of a complete hiding top coat, it seemed that only a No. 3 gray color would be suitable for the intended object because of its close reflectance value. To affirm the same, the following tests were then carried out:

Test gray colored (No.1~No.5) coating compositions each were applied over the test plates at complete hiding, and after drying, a RED SI top coat was then applied to it at 10, 15, 23, 28, 37 and 45μ (dry thickness), respectively.

Figure 6:
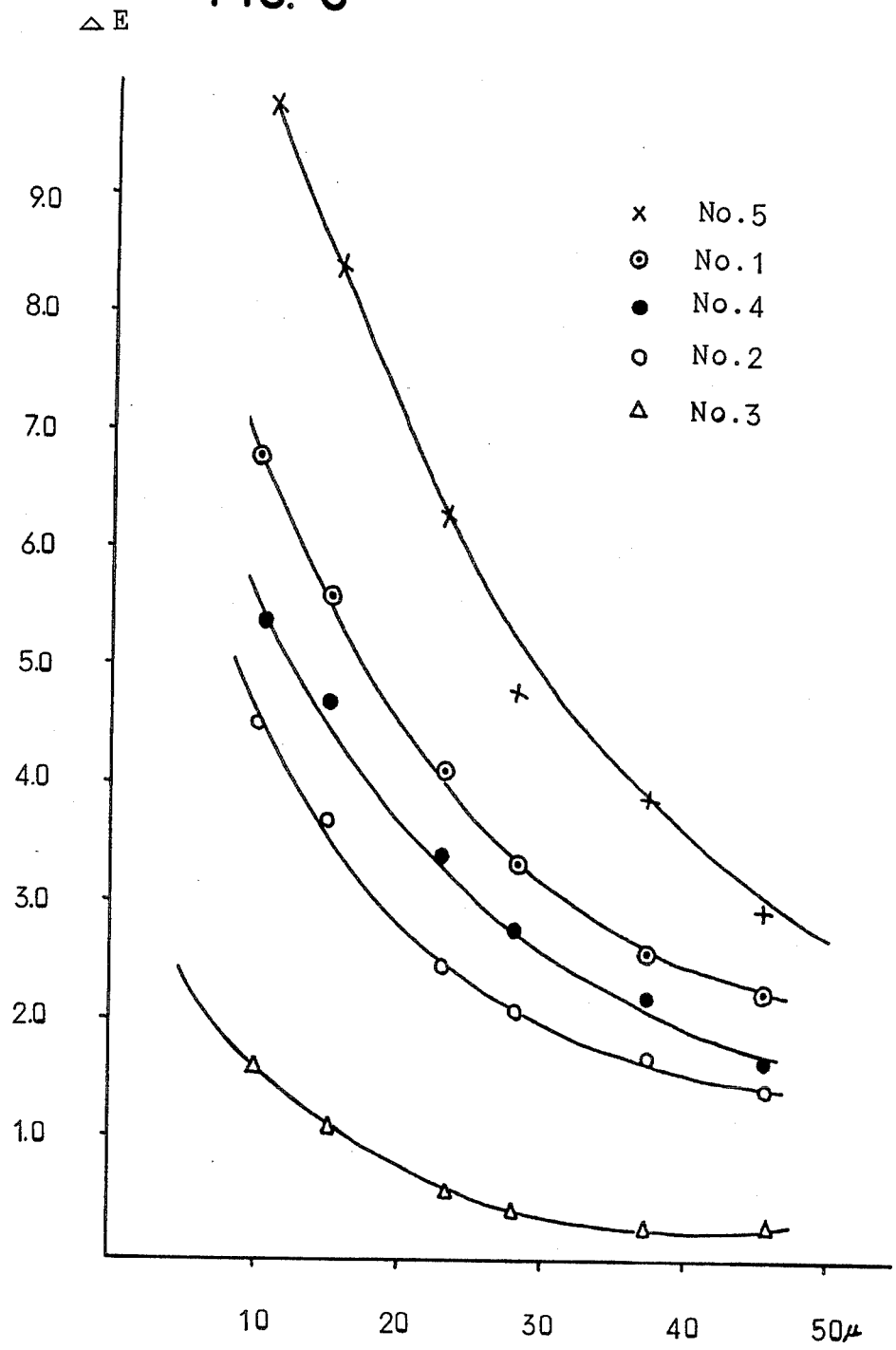

Each composite coating was compared with the complete hiding top coat and the color difference was determined by Hunter's formula and shown in the following Table 5. The results are also shown in FIG. 6, in which the vertical axis represents color difference and the horizontal axis film thickness of the top coat.

TABLE 5

| top coat thickness | gray color No. 1 | No. 2 | No. 3 | No. 4 | No. 5 |
|---|---|---|---|---|---|
| 10μ | 6.78 | 4.51 | 1.63 | 5.38 | 9.74 |
| 15μ | 5.65 | 3.69 | 1.11 | 4.69 | 8.27 |
| 23μ | 4.10 | 2.43 | 0.52 | 3.41 | 6.38 |
| 28μ | 3.34 | 2.18 | 0.41 | 2.78 | 4.78 |
| 37μ | 2.59 | 1.70 | 0.29 | 2.23 | 3.95 |
| 45μ | 2.23 | 1.46 | 0.30 | 1.68 | 2.97 |

From these test results, it was concluded that the only intercoat color which gave a color difference of less than 1.0 as compared the color of composite coating wherein a RED SI top coat was applied over an intercoat at a thickness of 30~40μ (i.e. at incomplete hiding) with the color of the same top coat applied at complete hiding being No. 3 gray.

Similar experiments were carried out with other low hiding top colors of RED S2 (hiding power 110μ) and ORANGE SI (hiding power 165μ) and various grades of gray colors. Table 6 indicates the respective reflectances at 640, 660, 680 and 700 nm of each color applied at complete hiding and the average reflectance thereof.

When compared to the average reflectance of the respective top colors with those of the test gray colors, it is expected that a No. 6 gray colored intercoat is suitable for a RED S2 top coat and a No. 9 gray colored intercoat is suitable for an ORANGE S1 top coat.

TABLE 6

| wave-length (nm) | coat RED S2 | coat OR S1 | gray colored intercoats No. 6 | No. 7 | No. 8 | No. 9 | No. 10 |
|---|---|---|---|---|---|---|---|
| 640 | 25.68 | 55.24 | 27.24 | 30.75 | 39.64 | 55.69 | 59.82 |
| 660 | 26.81 | 56.85 | 26.79 | 30.53 | 39.34 | 55.45 | 59.58 |
| 680 | 27.65 | 56.89 | 26.75 | 30.23 | 39.05 | 55.11 | 59.25 |
| 700 | 28.52 | 56.43 | 26.54 | 30.20 | 38.80 | 54.83 | 58.99 |
| average refl. | 27.17 | 56.35 | 26.83 | 30.43 | 39.21 | 55.27 | 59.41 |

Figure 7:
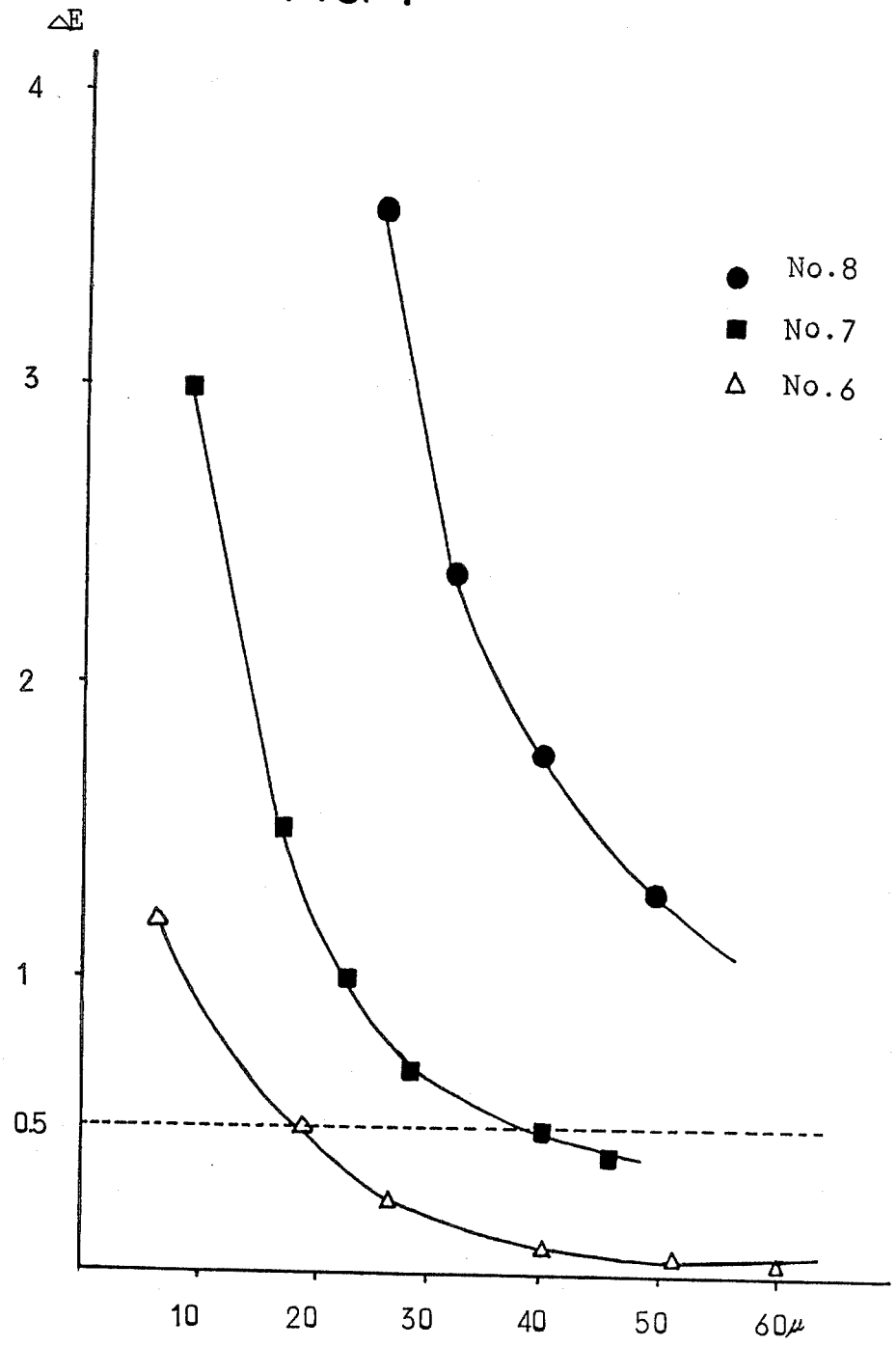
Figure 8:
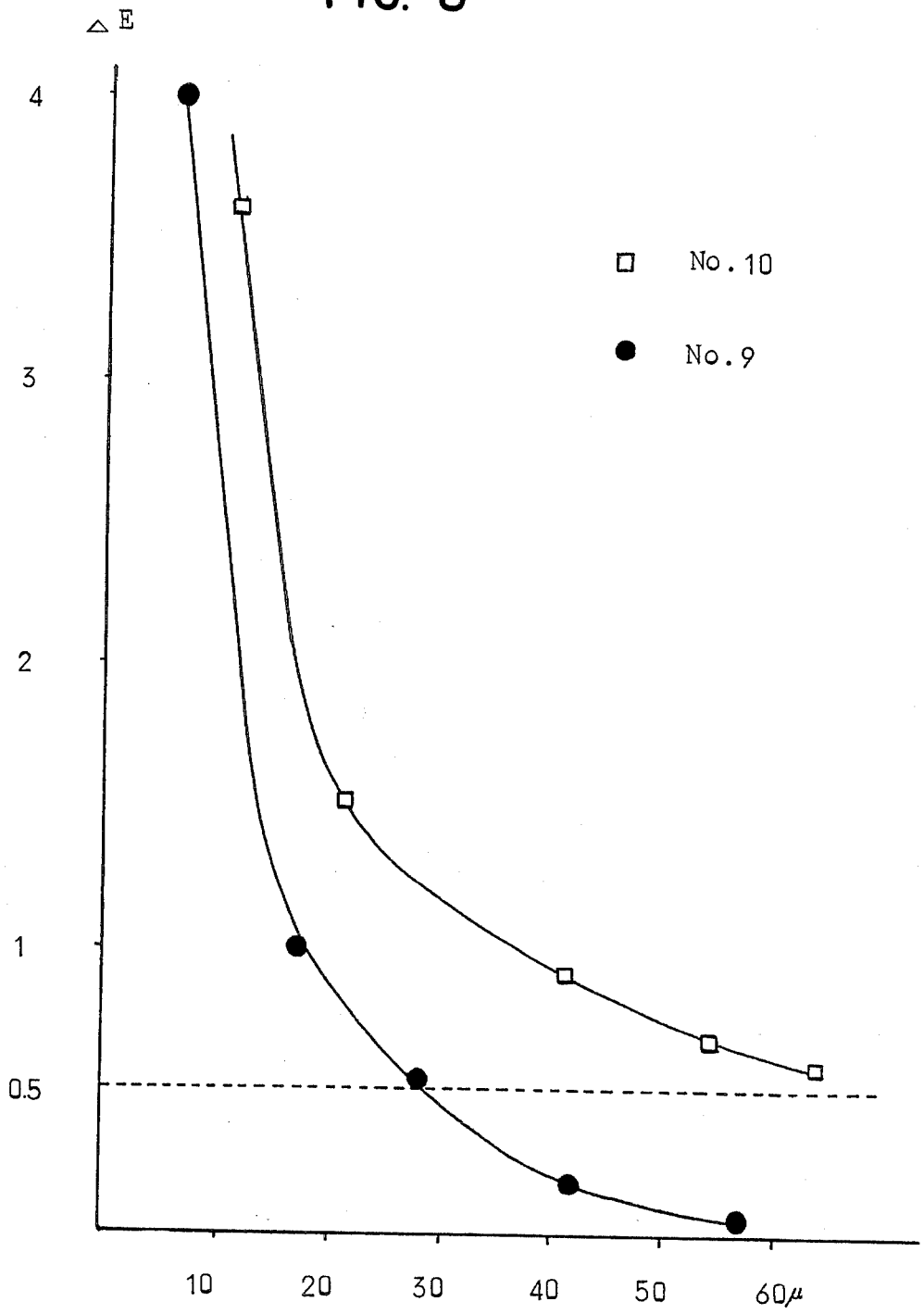

The inventors then actually applied the respective top coats over the respective gray colored intercoats at different film thicknesses, and the color differences between the resulting composite coating and the complete hiding top coat was measured and the results were shown in FIG. 7, FIG. 8 and Table 7. These drawings each show the correlation between the film thickness of the top coat and the color difference of the composite coating comprising the top coat applied over the respective gray colored intercoat at incomplete hiding as compared with the color of a complete hiding top coat and FIG. 7 is for the top coat of a RED S2 color and FIG. 8 is for the top coat of an ORANGE S1 color.

TABLE 7

| film thickness of top coat (μ) | (Color difference ΔE) top coat RED, intercoat gray No. 6 | No. 7 | No. 8 | ORANGE No. 9 | No. 10 |
|---|---|---|---|---|---|
| 20 | 0.46 | 1.18 | — | 0.82 | 1.60 |
| 30 | 0.18 | 0.64 | 2.60 | 0.46 | 1.16 |
| 40 | 0.08 | 0.48 | 1.74 | 0.20 | 0.92 |
| 50 | 0.05 | 0.36 | 1.25 | 0.08 | 0.72 |

From these test results, it was clear that the optimum intercoat colors capable of giving a color difference of less than 1.0 between the color of composite coating wherein the indicated top coat was applied over the gray colored intercoat at 30~40μ thickness and the color of the complete hiding top coat were No. 6 and No. 7 grays for RED S2 and No. 9 for ORANGE S1. These facts warrant the aforesaid statement.

Next, various top coat colors were applied at incomplete hiding on various gray intercoats, and following the procedures stated in the preceding paragraph (1), the spectral reflectance $R_o$(%) of the optimum gray, the reflectance range R(%) of allowable gray capable of giving ΔE* ab≦1.0 at ½T top coat and reflectance allowance from the optimum gray $R_o$ (%) were determined. However, in this series of tests, $R_o$ and R(%) were expressed by the mean values of the reflectances measured at four points at 20 nm interval in 640 tp 700 nm range. The test results are shown in the following Table 8.

TABLE 8

| top coat color*1 (Munsell renotation) | hiding power (μ) | spect. reflec. $R_o$ (%) of optimum gray*2 | reflectance range R (%) of allowable gray giving ΔE* ab ≦ 1.0 at ½T top coat*2 | reflectance allowance from optim. gray $R_o$ (%) |
|---|---|---|---|---|
| 5.2R/3.93/8.3 | 55 | 39.2 | 17.2~61.2 | −22~+22 |
| 3.4R/3.1/5.4 | 106 | 27.1 | 12.1~42.1 | −15~+15 |
| 0.7YR/5.7/11.2 | 54 | 72.1 | 49.1~85.0*3 | −23~+12.9 |
| 3.6Y/7.6/7.5 | 24 | 61.8 | 50.8~72.8 | −11~+11 |

TABLE 8-continued

| top coat color*1 (Munsell renotation) | hiding power (μ) | spect. reflec. $R_o$ (%) of optimum gray*2 | reflectance range R (%) of allowable gray giving ΔE* ab ≦ 1.0 at ½T top coat*2 | reflectance allowance from optim. gray $R_o$ (%) |
|---|---|---|---|---|
| 2.6Y/8.1/2.5 | 43 | 67.3 | 42.3~85.0*3 | −25~+17.7 |

*1hue/value/chroma:
*2expressed by mean value of reflectances measured at four points at 20 nm interval in 640 to 700 nm range.:
*3used 85.00 as average reflectance of white color.

From these experiments, it is clear that for this type of top coat colors, if the intercoat color is selected from gray colors whose reflectance, expressed in terms of average value of the reflectances measured at 4 points at intervals of 20 nm in a longer wave length from 640 to 700 nm, is within ±25% of the corresponding value of complete hiding top coat.

Though the inventions have been explained on the cases wherein a conventional type of top coat containing a normal concentration of pigment is applied over the intercoat at a reduced film thickness, it is to be understood that the invention likewise includes cases wherein a top coat paint containing a lesser amount of pigment is applied over an intercoat at a normal film thickness, thereby attaining the same effect of incomplete hiding. This may be clearly known from the following test results.

TABLE 9

| top coat color (Munsell renotation*1 | pigment conc. % | hiding power μ | top coat thick. μ*2 | intercoat |
|---|---|---|---|---|
| 8.15G/3.06/1.69 | 5.7 | 47 | 47 | any grays |
| | 2.5 | 119 | 40 | opt. gray |
| 4.36PB/2.72/1.71 | 5.2 | 52 | 52 | any grays |
| | 2.9 | 95 | 60 | opt. gray |
| 5.42R/3.83/8.59 | 22.7 | 52 | 52 | any grays |
| | 9.6 | 109 | 30 | opt. gray |
| 3.80R/2.15/4.91 | 20.3 | 41 | 41 | any grays |
| | 9.1 | 95 | 35 | opt. gray |

*1hue/value/chroma:
*2top coat film thickness required for giving color difference of less than 1.0 as compared with the complete hiding top coat This invention also intends to include a top coat of a metallic coating composition.

In the statements of claims and specification, the term "gray color" is to be interpreted as including mixed colors of white and black and any and every colors having Munsell chroma of less than 4, and preferably less than 2.

I claim:

1. In a method of forming a multi-layer coating comprising applying over an intercoat, a top coat under incomplete hiding conditions so as to produce a color very similar to that of a top coat applied at complete hiding, the improvement wherein the intercoat color is selected from white or gray colors whose spectral reflectance comes as close as possible to the maximum value of the spectral reflectance curve of the complete hiding top coat.

2. A method according to claim 1, wherein the top coat is possessed of a color whose spectral reflectance curves have the largest or maximum peak in a wavelength region of over 640 nm, said color similarity being such that when the top coat is applied over the intercoat at one half of the film thickness required for complete hiding, the color difference is less than 1.0 as compared with the color of a complete hiding top coat, and wherein the stipulation that the spectral reflectance of the intercoat comes as close as possible to the maximum value of the complete hiding top coat means that, when expressed in terms of average value of the spectral reflectances measured at 4 points at intervals of 20 nm in a longer wavelength region ranging from 640 to 700 nm, it has an average reflectance which is within ±25% of that of the complete hiding top coat.

3. A method according to claim 1 wherein the top coat is possessed of color whose spectral reflectance curves have the largest and maximum peak in a wavelength region of less than 640 nm, and the color similarity is such that when the top coat is applied at one half of the film thickness required for complete hiding, the color difference is less than 1.0 as compared with the color of the complete hiding top coat, and the stipulation that the spectral reflectance of the intercoat comes as close as possible to the maximum value of the complete hiding top coat means a spectral reflectance which is within ±28% of the maximum reflectance, measured at a wavelength at which the spectral reflectance curve of the complete hiding top coat shows a maximum value.

* * * * *